US005272981A

United States Patent [19]

Badura et al.

[11] Patent Number: 5,272,981

[45] Date of Patent: Dec. 28, 1993

[54] PROJECTILE FOR A DEFENSIVE PROJECTING DEVICE

[75] Inventors: Wolfgang Badura; Fritz Greindl, both of Bad Reichenhall, Fed. Rep. of Germany

[73] Assignee: Buck Werke GmbH & Co., Uberkingen, Fed. Rep. of Germany

[21] Appl. No.: 907,043

[22] Filed: Jul. 1, 1992

[30] Foreign Application Priority Data

Jul. 31, 1991 [DE] Fed. Rep. of Germany ..... 4125355

[51] Int. Cl.[5] ..... F42B 12/48; F42B 12/68

[52] U.S. Cl. ..... 102/370; 102/334; 102/504

[58] Field of Search ..... 102/370, 504, 275, 274, 102/334

[56] References Cited

U.S. PATENT DOCUMENTS

| | | | |
|---|---|---|---|
| 2,805,622 | 9/1957 | Cammin-Christy | 102/504 |
| 3,726,226 | 4/1973 | Grandy | 102/334 |
| 4,526,105 | 7/1985 | Herren | 102/274 |
| 4,726,295 | 2/1988 | Embury et al. | 102/334 |
| 4,967,636 | 11/1990 | Murray et al. | 102/370 |
| 5,042,390 | 8/1991 | Schotter | 102/504 |

FOREIGN PATENT DOCUMENTS 330030 6/1976 Austria .

*Primary Examiner*—David H. Brown

*Attorney, Agent, or Firm*—Watson, Cole, Grindle & Watson

[57] ABSTRACT

A projectile to be fired by a electric ignition defensive projector attached to an object to be defended has a propellant charge and an active charge and ignition devices for igniting the propellant and active charges. The active charge-ignition device is a mechanical ignition device including a firing pin and a firing pin spring. The mechanical ignition device is tensioned and released by a grappling line which is connected to the projector or a part of a projectile which remains in the projector, and is likewise connected to the firing pin. After the projectile has been fired and when it has travelled through a range of fire that corresponds to the length of the grappling line, then the firing pin spring is tensioned by the now taut grappling line and the firing pin is subsequently released which then ignite the active charge of the projector via a percussion cap and a pyrotechnical igniter train.

9 Claims, 2 Drawing Sheets

PROJECTILE FOR A DEFENSIVE PROJECTING DEVICE

BACKGROUND OF THE INVENTION

This invention relates to a defensive projecting device as used, for example, for defending tanks. The device comprises a plurality of projectors which are attached at suitable locations to the exterior of the tank, and projectiles inserted into the projectors and which include a propellant charge and an active charge, the latter usually being a smoke charge. The projectiles are electrically ignited from inside the tank where ignition contacts, which make contact with contact rings located on the projectile shell, are disposed in the projector.

Ignition systems are also known which have no contacts namely, inductive ignition systems. The electric energy received by means of contacts or without contacts is used in projectiles to ignite the propellant charge such that the hot propellant gases in turn ignite the active charge by means of a pyrotechnical igniter train with a delay element.

The safety and effectiveness of the protective measures for such projecting devices are of special importance. It must be assured that the active charge does not ignite in the projector (barrel safety) or in the vicinity of the barrel muzzle (pre-barrel safety and trajectory safety), and the latter must not occur even if the projectile impacts an impediment (such as a tree) before reaching its specified range. These safety problems result, moreover, even if the active charge is not ignited by a pyrotechnical igniter train but rather by an impact fuse. The effectiveness of the safety measures depends, firstly, on the projectile's accuracy of firing and, secondly, on the time span between the instant the projectile is fired and the occurence of the protection such as, for example, the formation of the smoke cloud.

With present projecting devices, the projectile is usually fired at a 45° angle relative to the horizontal, so that the trajectory of the projectile is quite steep which thereby leads to a comparatively long flight time. This results in delayed effectiveness and additionally causes problems in assuring that the active charge becomes effective precisely at the desired height above the ground because in the steep falling phase of its trajectory the projectile travels at a high speed resulting in the smallest deviations from the instant of igniting having a significant impact. However, with the further development of attack measures the projective measures must be improved, in particular, to provide that the defense actions occur faster than before. For this reason attempts have been made to proceed from the previously steep trajectories to significantly flatter trajectories, in particular, down to 10° from the horizontal. In such manner, not only is the flight duration significantly reduced, but also the maintenance of the desired effective height over the ground is facilitated. However, it becomes more difficult to maintain the accuracy of firing in the horizontal reach and above all causes problems to assure safety, in particular, the pre-barrel and trajectory safety. In so doing, it should be taken into consideration that for example, for a tank defensive system the firing range of the projectiles should be 40 to 50 meters, this distance being traveled in the shortest period of time by the projectile on a flat trajectory. Tests have shown that with present pyrotechnical igniter trains it is hardly possible to assure the requisite safety and the desired accuracy of firing.

SUMMARY OF THE INVENTION

It is therefore an object of the present invention to provide a defensive projecting device of the aforedescribed type in such a manner that even for flat and short trajectories safety and accuracy of firing are assured.

According to the invention, a projectile to be fired by an electric ignition defensive projector attached to an object to be defended, has a propellant charge and an active charge and ignition devices for igniting the charges. The active charge-ignition device has a firing pin and a firing pin tension spring, the device being connected to one end of a grappling line which serves to tighten the spring and to trigger the firing pin. The other end of the grappling line is attached to the projector or its head with a part remaining in the projector. The grappling line is slightly shorter than the firing range of the projectile that is predetermined by the propellant charge.

Thus, according to the invention, the mortar shell is still connected to the firing cite by means of a grappling line after it has been fired. The length of this grappling line is dimensioned in such a manner that upon reaching the predetermined firing range it is fully extended due to the projectile, with the result that it decelerates the projectile with a jerk and, in so doing, tensions the firing pin spring and releases the firing pin, so that the firing pin ignites the active charge, for example, by means of a percussion cap and an igniter composition. Thus, the actual firing range of the projectile is determined by the length of the grappling line, an approach that can be carried out with very high accuracy and leads to an unusually high accuracy of firing. In addition, the firing pin spring is not tensioned until the grappling line is pulled and then the firing pin is released, a condition that leads to very high barrel, pre-barrel and trajectory safety. It is important that the grappling line be slightly shorter than corresponding to the firing range specified by the propellant charge, or the propellant charge would enable the projectile a somewhat greater firing than is allowed by the grappling line because only then the jerk require to tension the firing pin spring occurs. If the projectile were to strike the ground actually at the distance at the firing point, that corresponds to the length of the line, the active charge would never be ignited. Thus, even directly in front of the desired target, safety is nevertheless increased (final phase safety).

DETAILED DESCRIPTION OF THE INVENTION

Figure 1:
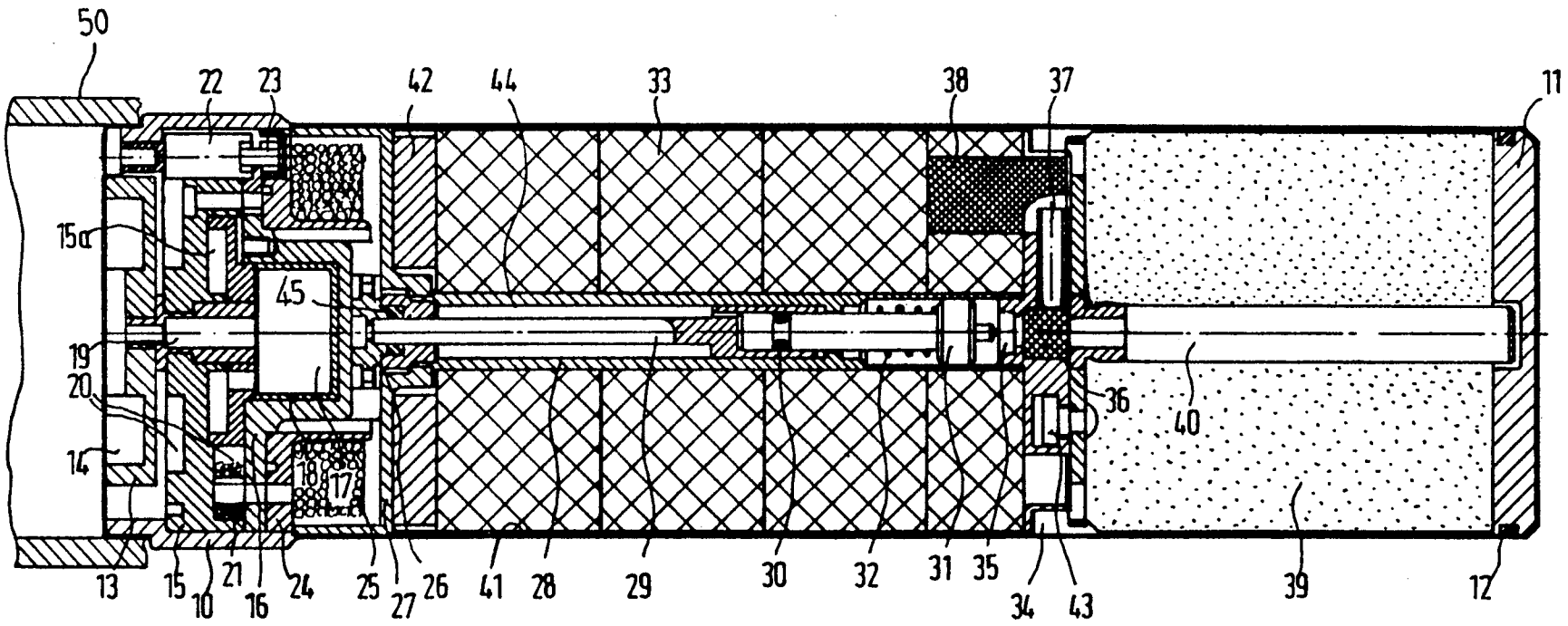
FIG. 1 is a longitudinal sectional view, partly in section, of the projectile of the projecting device according to the invention.

The projectile shown in FIG. 1 has a cup-like housing sleeve 10 with the region adjoining the cup bottom being thickened and with the front cup opening thereof being closed by a cover 11 which forms the bottom of a spontaneous active charge to be explained in more detail hereinafter. Cover 11 is held in place by the flange of a sleeve rim (not shown) and a seal ring 12 providing a watertight closure. The secondary portion of an inductive ignition system, comprising a ferrite core 13 and a transformer coil 14, is attached to the cup bottom.

A comparatively solid and heavy armature cover 15 having a central bore, on which a propellant chamber housing 16 rests which in turn defines a propellant charge chamber 18, rests on the cup bottom. Propellant charge chamber 18 is covered relative to the central bore of armature cover 15. A squib 19 is located within the central bore, and is covered by a thin foil.

A recess 20, covered by the propellant chamber housing 16, contains a primary portion or grappling member 21 which comprises comparatively short grappling lines one end of each being attached to armature cover 15 which in turn is attached to the cup bottom by means of a separating element 22 and a time delay element 23. Six such circumferentially spaced primary grappling lines are provided which together have an axis concentric with the longitudinal axis of the projectile.

A drum 24 for a grappling line secondary member 25 is fixed within a central opening of annular bottom 27 of a point smoke body container, and rests on the propellant chamber housing 16. Member 25 comprises a comparatively long grappling line one end of which is attached to drum 24 and the other end of which is attached to a central member 26 which is fixed in a central opening of annular bottom 27 of a point smoke body container.

A central supporting tube 28 extends from the central opening of annular bottom 27. A slideable piston rod 29 is located within tube 28, one end of the piston rod being attached to central member 26 and the other end thereof being attached to a firing pin 31 by means of a coupling element 30. The firing pin has a tension spring 32 associated therewith.

A point smoke charge 33 comprises annular bodies covered at one end by a compensating disk 42 and at the opposite end by an ignition distributor cover 34, the point smoke charge being housed in an annular chamber formed between the point smoke body container 41 and support tube 28. Ignition distributor cover 34 contains a percussion cap 35 which is located in the path of movement of firing pin 31. Cover 34 further contains a sympathetic charge 36, a delay element 37 and an igniting composition 38 for the point-smoke charge 33.

A spontaneous smoke body 39 contains an ignition self-destructive charge 40 which is elongated along the firing pin axis. Charge 40 communicates with sympathetic charge 36 via an opening in ignition distributor cover 34, and is arranged or is located outside ignition distributor cover 34. Point smoke body container 41 is connected to spontaneous smoke body 39 via a coupling pin 43, thereby forming an active charge-double body.

The operating mode of the projectile will now be described. To initiating firing, an electric surge is transmitted to the primary side of the inductive ignition system located in the bottom of projector 50. A current is thereby produced in secondary coil 14 of the ignition system which current ignites detonating composition 19 via a connecting wire. Composition 19 in turn ignites propellant charge 17 while bursting through the cover foil. The propellant gases developing at this stage travel through the bores into an annular chamber 15*a*, with the result that the double body 39, 41 of the projectile is closed while the front-sided bead is open from sleeve 10 and thus pushed out of the projector 50. In addition to sleeve 10, armature cover 15 with separating element 22 and delay element 23 and secondary portion 13, 14 of the ignition system remain in the projector.

Primary portion 21 of the grappling line whose one end is attached to the propellant charge housing 16 is also dragged with the projectile double body. In so doing, the length of the six individual lines of primary portion 21 is dimensioned in such a manner that they are totally taut when the double body have left the opening of housing sleeve 10, at which instant propellant charge 17 has also burned off. The length of primary portion 21 of the grappling line may be about 0.5 m.

As soon as this instant of complete tautness of the primary portion 21 is reached, the grappling lines attached to propellant charge housing 16 tightly hold housing 16 so that a short piece of it "remain standing" in front of the aperture of the housing sleeve, whereas the remaining portion of the double body travels on. In such manner secondary member 25 of the grappling line becomes effective, such line being wound on drum 24 between the remaining housing 16 and central element 26 and unwinds at this stage which is illustrated in FIG. 2A.

Figures 2A, 2B, 2C, 2D:
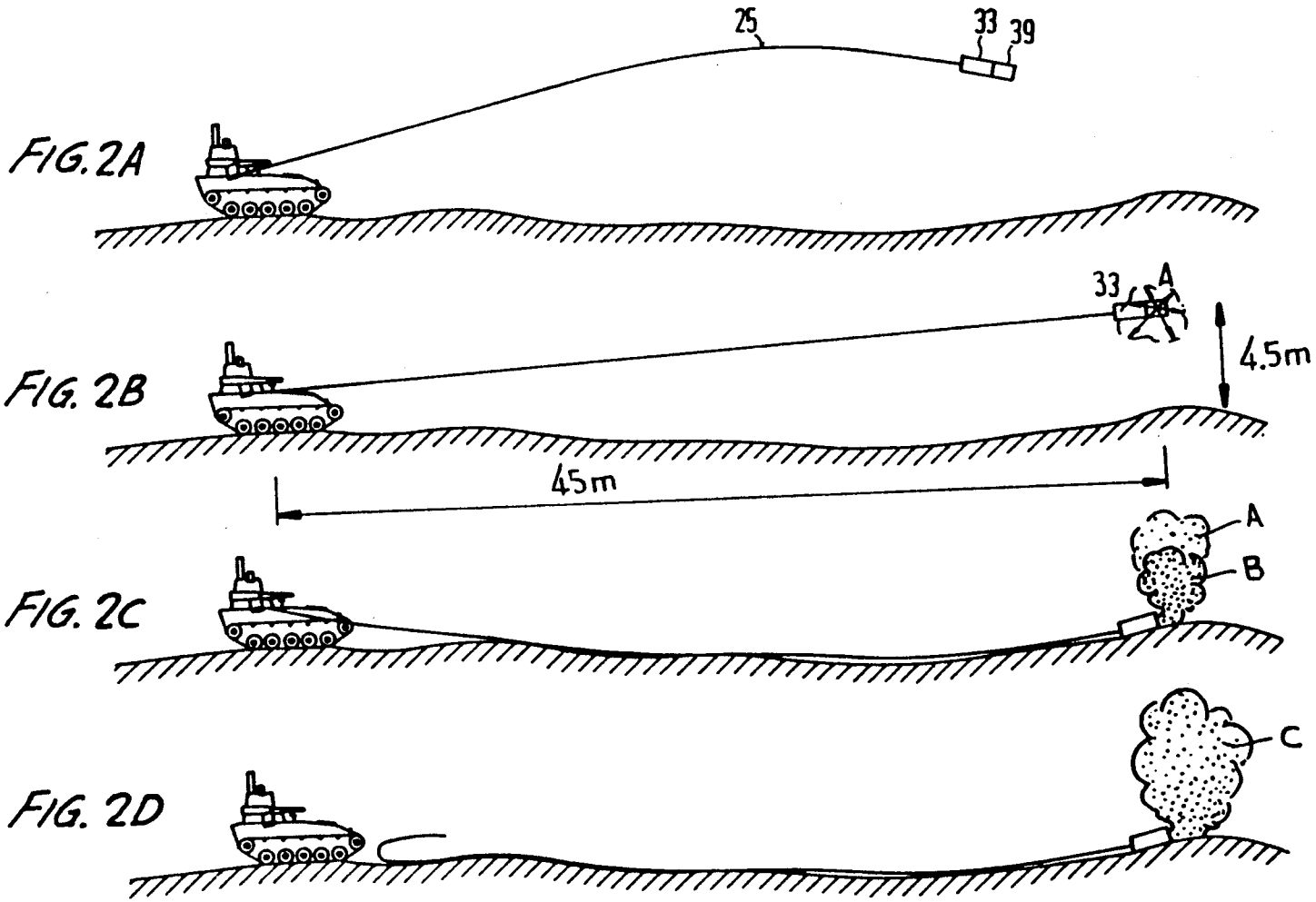
FIGS. 2A to 2D are schematic illustrations of the operating mode of the projecting device showing the projectile as it is fired.

As soon as this secondary member 25 of the grappling line is totally unwound and taut, the grappling line ignites the projectile as illustrated in FIG. 2B. The projectile is for example, at a distance of 45 m. from the firing site and at a height of 4.5 m. above the ground. Igniting occurs in such a manner that the secondary member 25 of the grappling line pulls suddenly on central element 26 with a result that the firing pin 31 is pulled to the rear via piston rod 29 thus tensioning spring 22. As pointed out the aforementioned "jerk" is dampened thereby permitting use of a comparatively small grappling line cross-section. This dampening is effected by the expansion of the grappling line system and/or the provision of an air column 44 which is compressed by piston rod 29 thereby forming a pneumatic dampener.

Following complete tensioning of spring 32, firing pin 31 strikes against the stop, and is a result of the additional pull of the grappling line on central element 26 and thus on piston rod 29 tears coupling element 30, i.e., the connection between piston rod 29 and firing pin 31 is severed, so that the firing pin strikes toward the front against percussion cap 35 as spring 32 relaxes. In so doing, this movement is still supported by the inertia of the firing pin. Percussion cap 35 struck by the firing pin ignites sympathetic charge 36, which in turn ignites self-destructive 40, thus resulting in the spontaneous development of smoke from smoke charge 39. Sympathetic charge 36, however, also simultaneously ignites time delay element 37, which ignites the igniting compositions 38 following a certain time delay, with a result that the point smoke composition 33 begins to form smoke. This instant, in which there is still spontaneous smoke in the point charge is just starting is shown in FIG. 2C, the spontaneous smoke is referenced A, the point smoke is referenced B. At this instance the single smoke body that is smoking at the rear has reached the ground. As time advances only this point smoke charge 33 produces smoke C, as shown in FIG. 2D.

It should be pointed out that the hot propellant gases are produced from the burning of the propellant charge 17 have also ignited the time delay 23 via its own channel. This time delay is measured in such a manner that it has completely burned as soon as the point smoke body has reached the ground, for example, two seconds after firing, and ignites separating device 22 which severs the connection at armature cover 25 with respect to housing sleeve. Thus, the grappling lines are separated from the portion of the projectile remaining in the projector, as shown in FIG. 2D.

Despite the intended flat trajectory of the projectile, the grappling line system assures an accurate ignition at the desired distance from the firing site, and in particular at the specified height above the ground. If, as in the present embodiment, the projectile involves a double body there is a problem of operating the double body at a speed of about 150 km/h at the target point, where the front body is to release a smoke cloud and the rear body is to release a smoke cloud on the ground. Both smoke clouds are to mix, i.e., form a total cloud such as C (FIG. 2D) stacked one above the other spacially. To achieve this, an extremely accurate ignition is apparently required, and this is achieved with the aforedescribed grappling line system. Thus, the interception of the propellant charge housing 16 and drum 24 via primary grappling lines 21 just before the double body leaves the aperture of the housing sleeve 10 is also important. In this manner the mass of the double body is shifted to the front thereby resulting in the double body travelling accurately and the secondary grappling line unwinding accurately.

By dividing the grappling line system into a primary portion comprising a plurality of grappling lines, and a secondary portion comprising only a single grappling line, high grappling line reliabilty in the region of the hot propellant gases is effected without requiring much space and weight for the grappling line system in the projectile. Of course, the front end of the secondary portion of the grappling line can also be divided into several individual grappling lines in order to obtain as axial a pull as possible at central element 26.

To increase reliability firing pin 31 has a tension relief in the form of clamp ring 45 which prevents the firing pin spring from tightening during flight. The clamping force ring 45 is not overcome until the interception energy at the target point is reach which then allows spring 32 to be tensioned.

As aforedescribed, the division of the active charge into a spontaneous composition and a point composition assures a virtually instantaneous smoke effect. For adequate smoke duration the described grappling line system requires accuracy of ignition.

It is especially expedient to design the projectors of the projecting device as firing magazines as disclosed in U.S. patent application Ser. No. 921,733, filed on even date herewith and commonly owned herewith, and based on German Patent Application No. P 41 25 356.6, filed Jul. 31, 1991.

What is claimed is:

1. A projectile to be fired by a electric ignition defensive projector attached to an object to be defended, the projectile having a propellant charge and an active charge and ignition devices for igniting the propellant charge and the active charge, the active charge-ignition device comprising a firing pin assembly including a firing pin and a firing pin tension spring, means defining a grappling line having a predetermined length and being connected at one end to the projector and at an opposite end to the firing pin assembly for tensioning the spring for thereby triggering the firing pin upon activation of the propellant charge-ignition device causing the projectile to the fired at a predetermined range determined by the propellant charge, the predetermined length of the grappling line means being slightly less than the predetermined range of fire for thereby activating the active charge ignition device.

2. The projectile according to claim 1, wherein the grappling line means comprises a primary portion and a secondary portion, the projector having a sleeve containing an armature cover which remains with the projector when the projectile is fired, the projectile having a propellant charge housing, the primary portion being attached to the armature cover and to the propellant charge housing, the active charge-ignition device further comprising a piston rod connected to the firing pin, the secondary portion being attached to the propellant charge housing and to the piston rod, and the propellant charge housing being detachable from the armature cover and from the active charge-ignition device.

3. The projectile according to claim 2, wherein the primary portion comprises a plurality of individual grappling lines together arranged concentric to the longitudinal axis of the projectile.

4. The projectile according to claim 2, wherein the piston rod is connected to the firing pin by a coupling element having a predetermined breaking point.

5. The projectile according to claim 2, wherein the active charge-ignition device further comprises pneumatic means for dampening the grappling line means.

6. The projectile according to claim 2, further comprising a spontaneous smoke charge, a self-destructive charge for the ignition of the spontaneous smoke charge, a point charge, and a delay element and an igniting charge for the ignition of the point charge.

7. The projectile according to claim 6, wherein an ignition charge is provided for the ignition of both the self-destructive charge and the delay element, and wherein the active charge ignition device comprises a percussion cap having a firing pin which impinges the cap and which ignites the igniting charge.

8. The projectile according to claim 7, wherein a pyrotechnical separating element is coupled to the delay element and is attached in such a manner to the armature cover that the propellant gases of the propellant charge ignite the separating element.

9. The projectile according to claim 8, wherein the ignition devices comprise an inductive ignition system including a ferrite core and a transformer coil contained in the sleeve.

* * * * *